US011125518B1

(12) United States Patent
Liu

(10) Patent No.: US 11,125,518 B1
(45) Date of Patent: Sep. 21, 2021

(54) BULLET RELOAD DEVICE

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 17/124,633

(22) Filed: Dec. 17, 2020

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS 4,939,862 A * 7/1990 Brandenburg ..... F41A 9/83 42/87
2019/0226780 A1* 7/2019 Slevin ..... F41A 9/83
2020/0049438 A1* 2/2020 Hatch ..... F41A 9/83

* cited by examiner

*Primary Examiner* — J. Woodrow Eldred
(74) *Attorney, Agent, or Firm* — Demian K. Jackson; Jackson IPG PLLC

(57) ABSTRACT

A bullet reload device includes a base, a roller seat, a roller and a flexible connection member. The grooves formed between the blades of the roller only let the bullets in the correct direction fall in, so that the bullets in the correct direction can move in a row. The line-up track of the base has a guide rail set therein, so that the extractor grooves of bullets can follow the guide rail to scroll from top to bottom in the line-up track without turning the direction, and thus, bullets can be neatly arranged in the line-up track. The flexible connection member is provided with a pressure plate connected to the roller seat by tension springs, so that pressing the pressure plate with the palm can conveniently apply force to move the flexible connection member downward along the non-linear line-up track to push the bullets into the magazine.

2 Claims, 12 Drawing Sheets

BULLET RELOAD DEVICE

BACKGROUND AND SUMMARY OF THE INVENTION

The present invention relates to a bullet reload device that can line up bullets in the correct direction and then fill the bullets into the magazine conveniently.

Filling the bullet into the magazine may easily cause sore hands or inconvenience. Therefore, the electronic magazine loader has been released on the market. When you want to fill bullets into the magazine, you must use an aligning device to fill the bullets in the same direction one at a time. However, when the bullet passes through the aligning device, there is still the possibility of turning (incorrect direction) and causing jamming. It is necessary to disassemble the electronic magazine loader for maintenance, which will cause user trouble. In addition, this kind of electronic magazine loader also needs to pre-set the number of bullets to be loaded in the magazine before activation, so its use is also limited.

The present invention has been accomplished under the circumstances in view. It is therefore the main object of the present invention to provide a bullet reload device, which is composed of a base, a roller seat, a roller and a flexible connection member, wherein the grooves formed between the blades of the roller only let the bullets in the correct direction fall in, so that the bullets in the correct direction can move in a row.

It is another object of the present invention to provide a bullet reload device, wherein the line-up track of the base has a guide rail set therein, so that the extractor grooves of bullets can follow the guide rail to scroll from top to bottom in the line-up track without turning the direction, and thus, bullets can be neatly arranged in the line-up track.

It is still another object of the present invention to provide a bullet reload device, wherein the flexible connection member is provided with a pressure plate that is connected to the roller seat by tension springs, so that simply pressing the pressure plate with the palm of your hand can conveniently apply force to move the flexible connection member downward along the non-linear line-up track to push the bullets into the magazine.

It is still another object of the present invention to provide a bullet reload device, which is so configured that there is no need to preset the number of bullets to be filled into the magazine, and you can fill in multiple bullets at a time and repeat the operation until the magazine is fully filled with bullets.

DETAILED DESCRIPTION OF THE INVENTION

Figure 1:
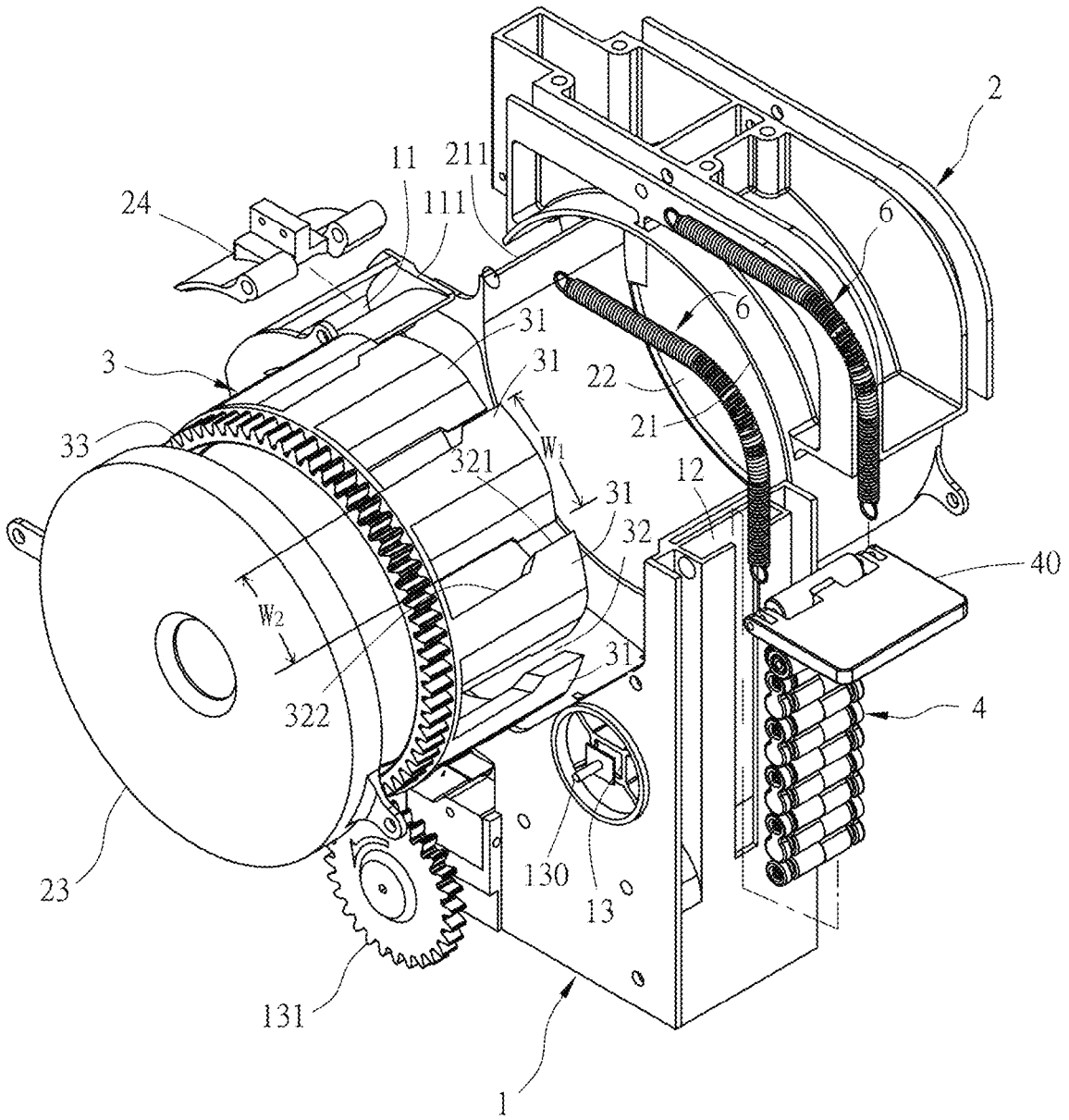
FIG. 1 is an exploded view of a bullet reload device in accordance with the present invention.
Figure 2:
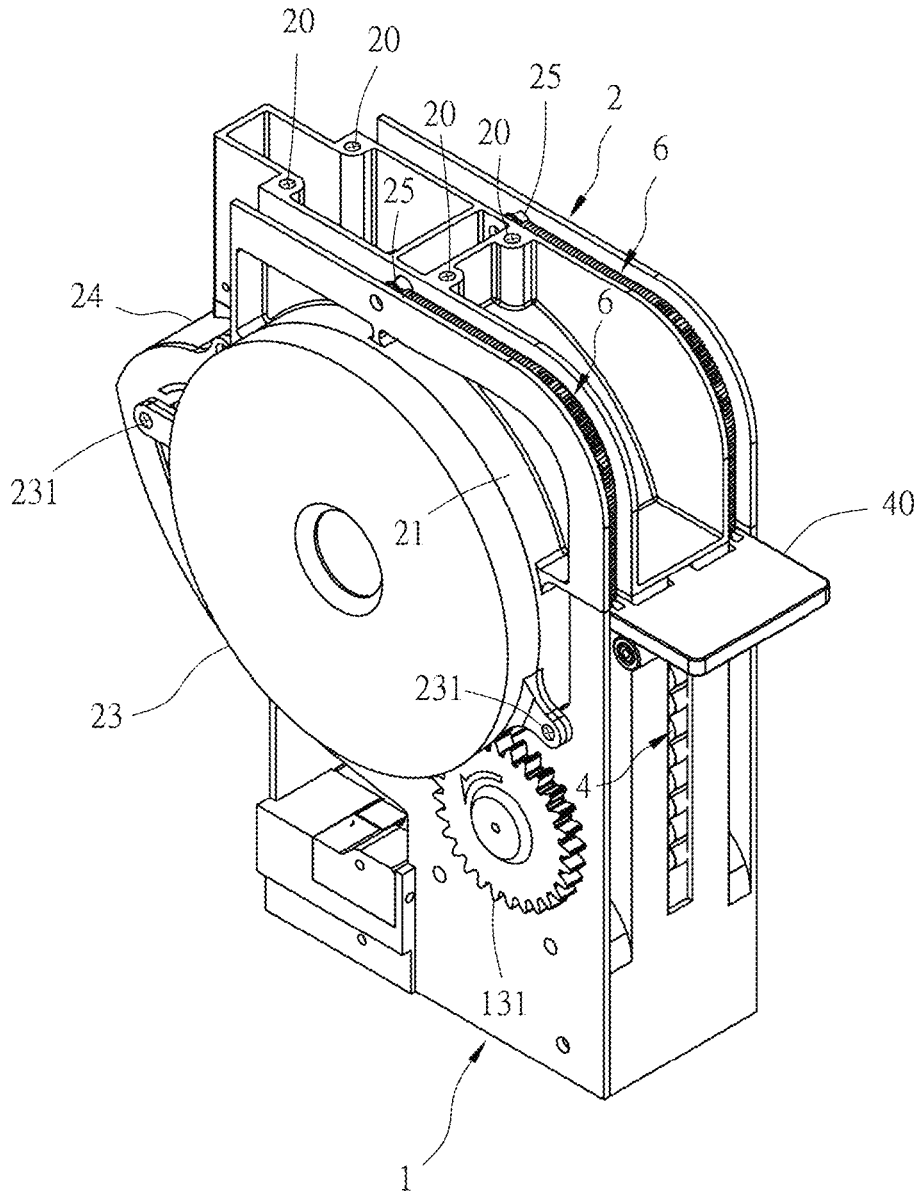
FIG. 2 is an oblique top elevational view of the bullet reload device in accordance with the present invention.
Figure 3:
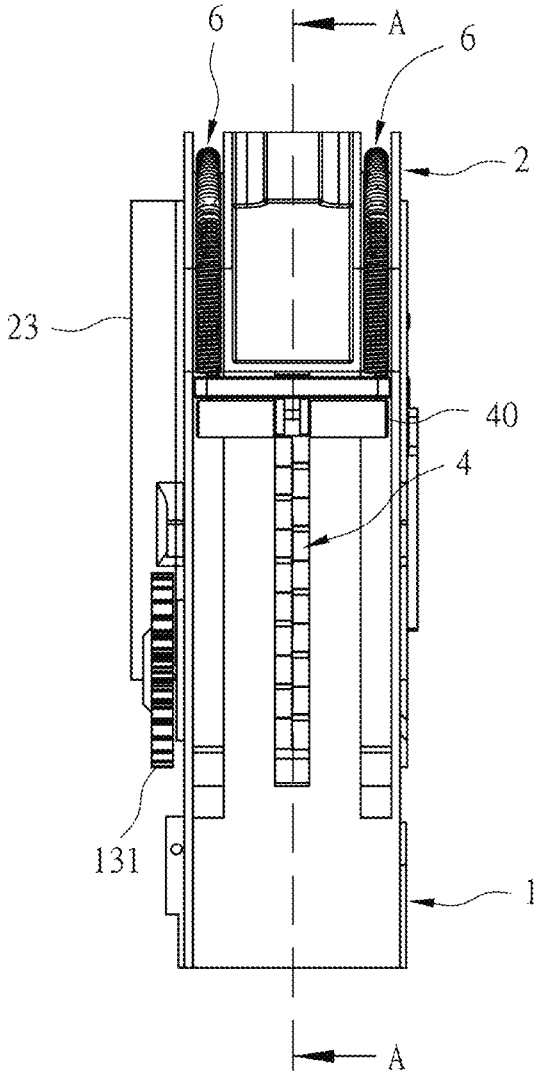
FIG. 3 is a side view of the bullet reload device in accordance with the present invention.
Figure 4:
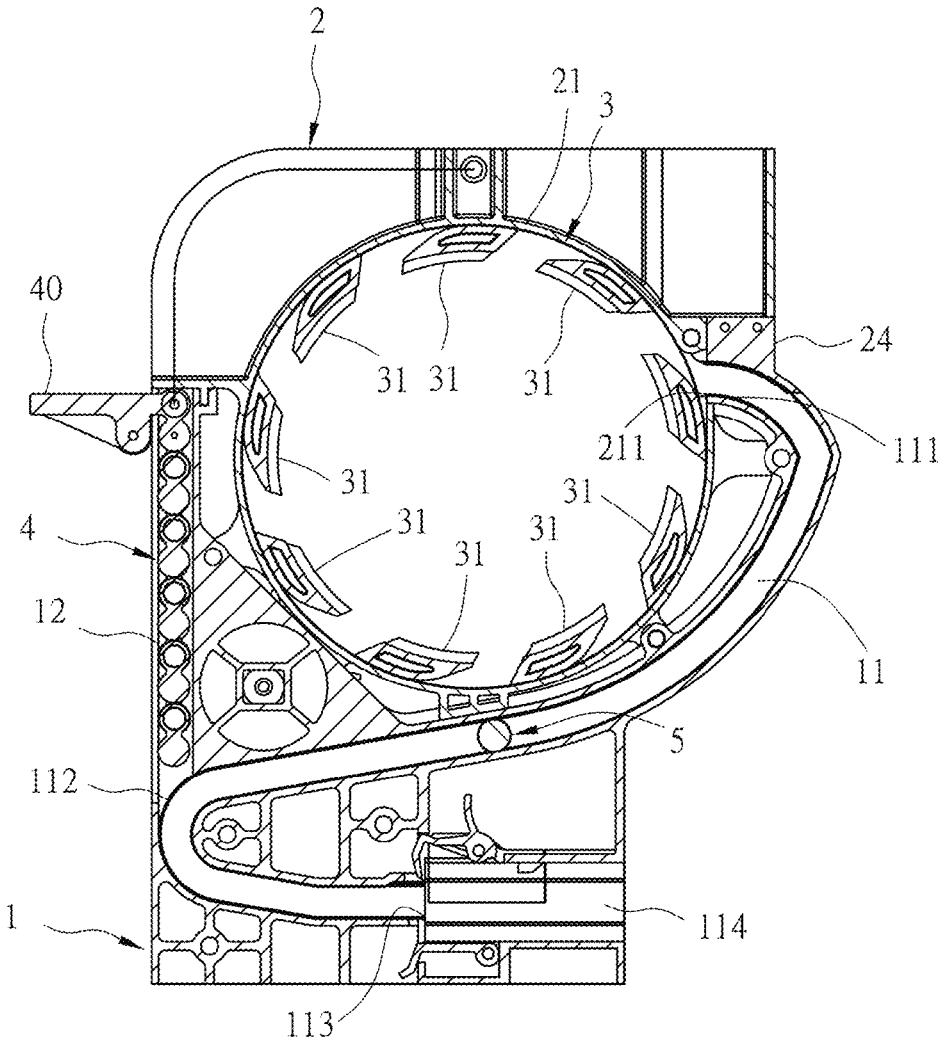
FIG. 4 is a sectional view taken along line A-A of FIG. 3.
Figure 5:
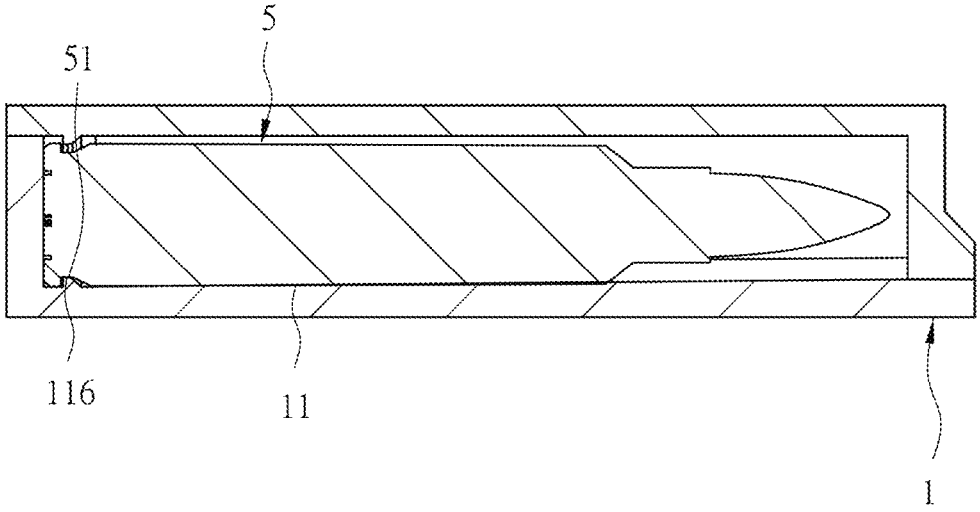
FIG. 5 is a schematic sectional view, showing the relationship between the guide rail of the line-up track and the extractor groove of the bullet.
Figure 6:
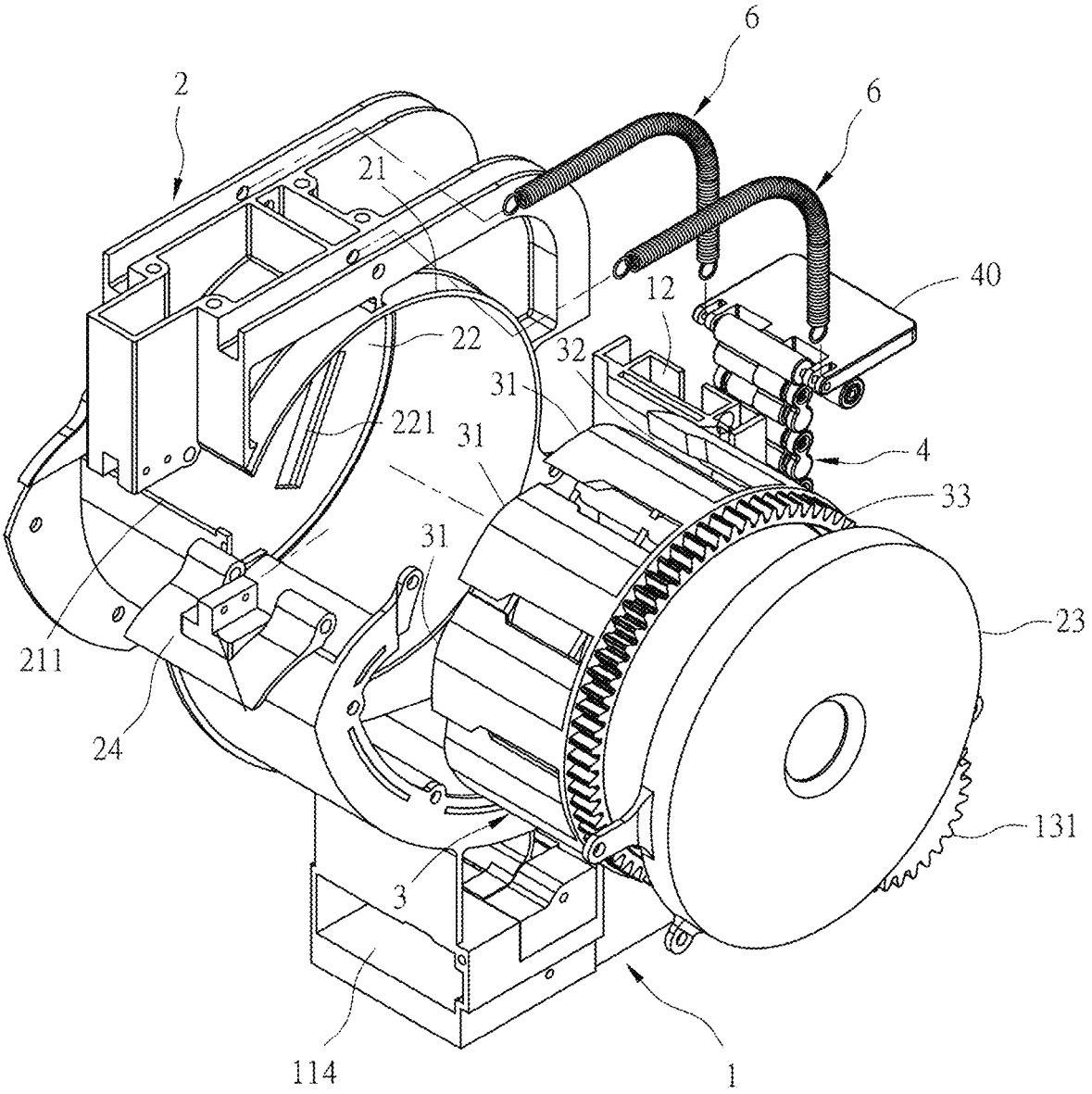
FIG. 6 corresponds to FIG. 1 when viewed from another direction.
Figure 7:
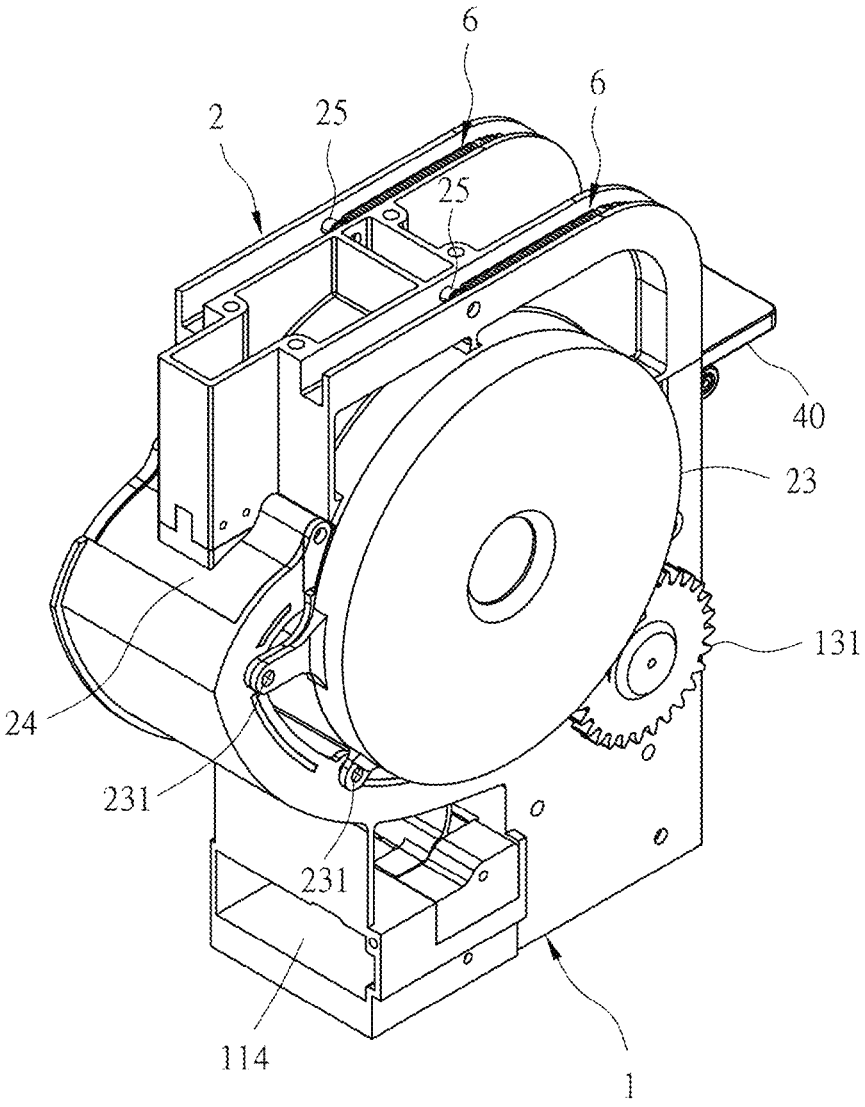
FIG. 7 corresponds to FIG. 2 when viewed from another direction.
Figure 8:
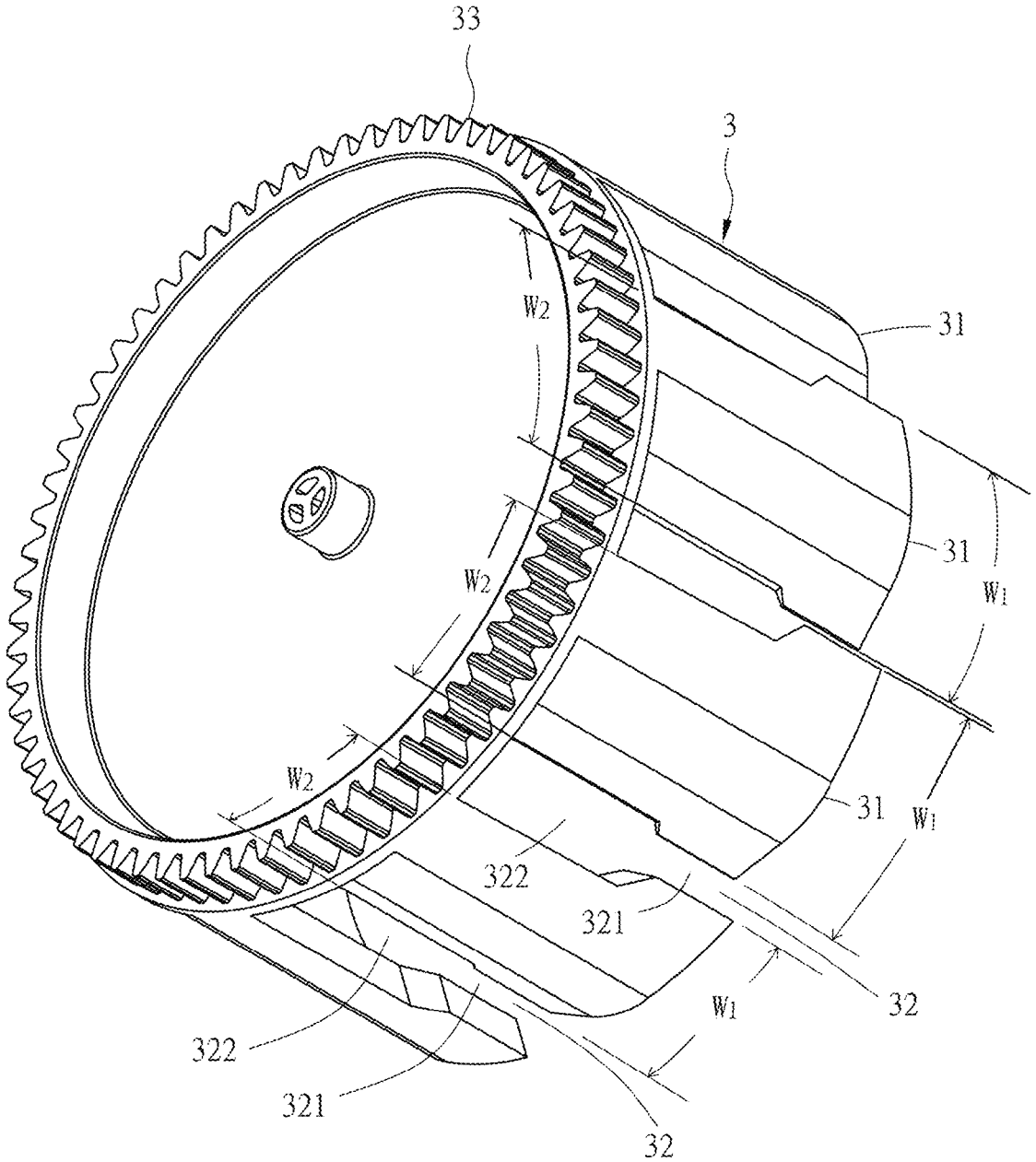
FIG. 8 is an oblique top elevational view, in an enlarged scale, of the roller.
Figure 9:
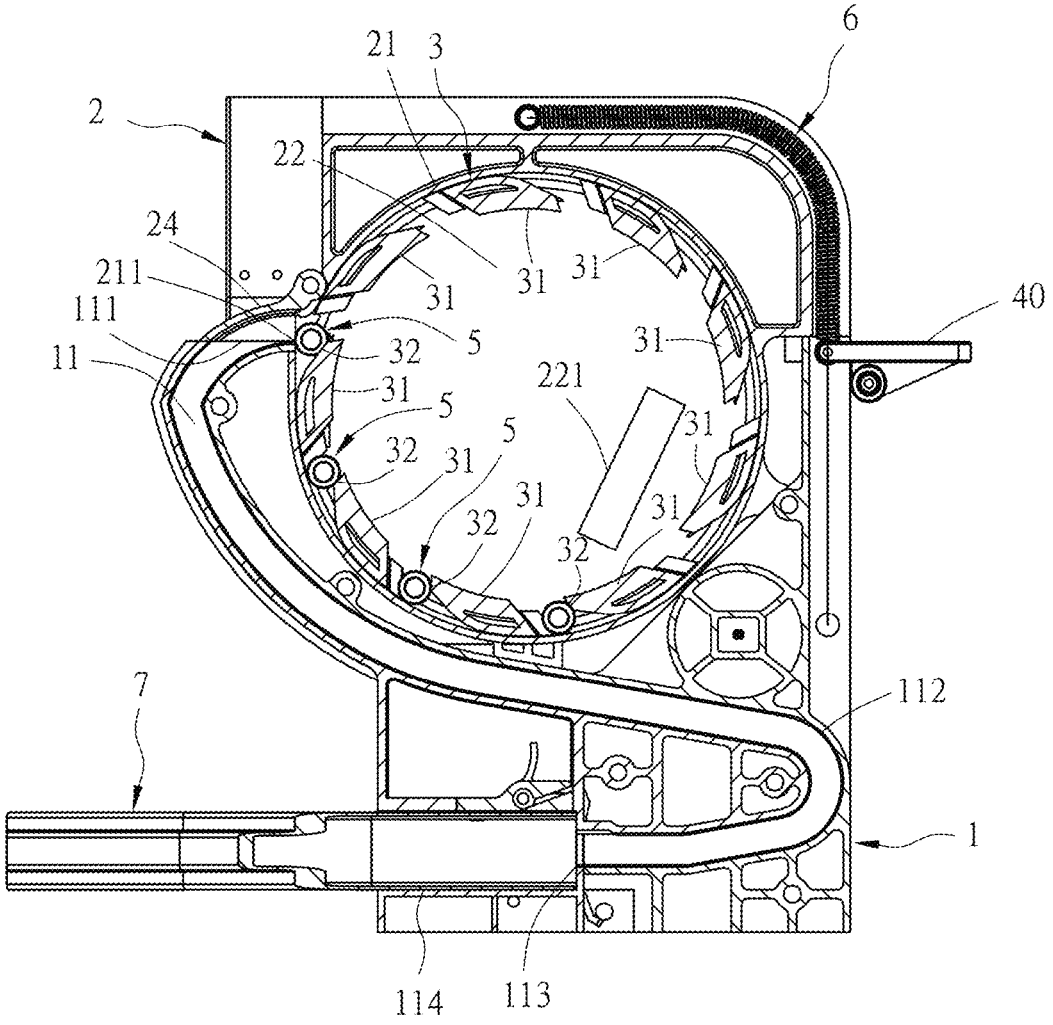
FIG. 9 is a schematic sectional view of the present invention, showing the bullet pulled by the adjacent blade out of the groove into the inlet end of the line-up track (I).
Figure 10:
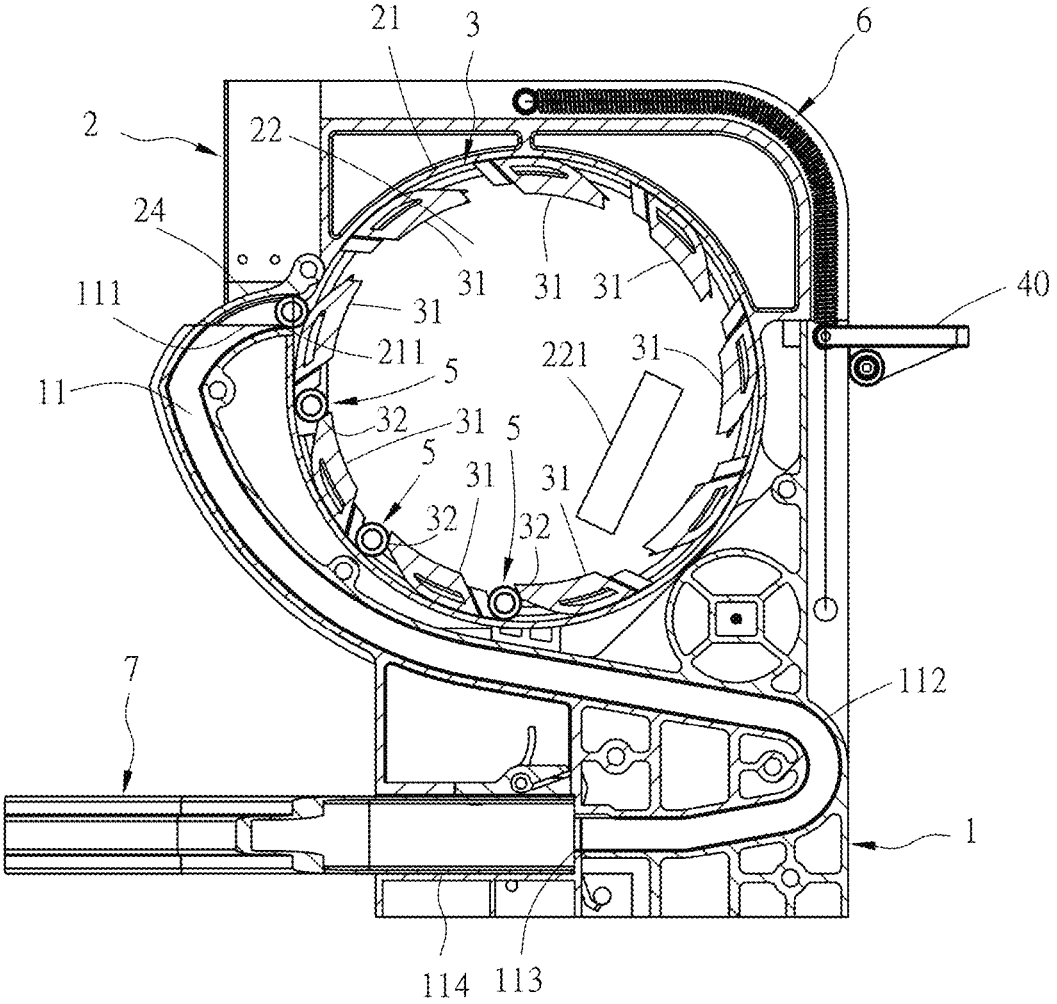
FIG. 10 is a schematic sectional view of the present invention, showing the bullet pulled by the adjacent blade out of the groove into the inlet end of the line-up track (II).
Figure 11:
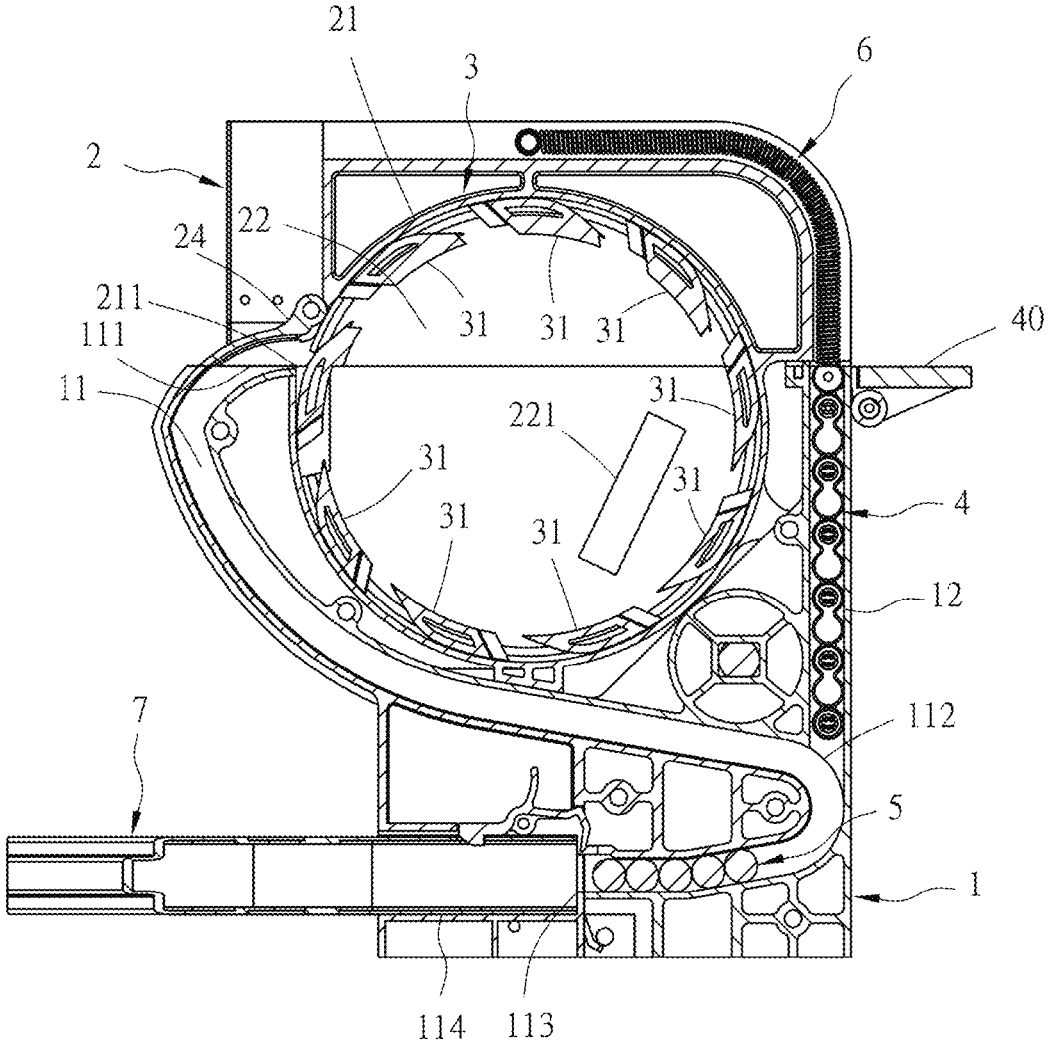
FIG. 11 is a schematic sectional view of the present invention, showing the pressure plate in the released status.
Figure 12:
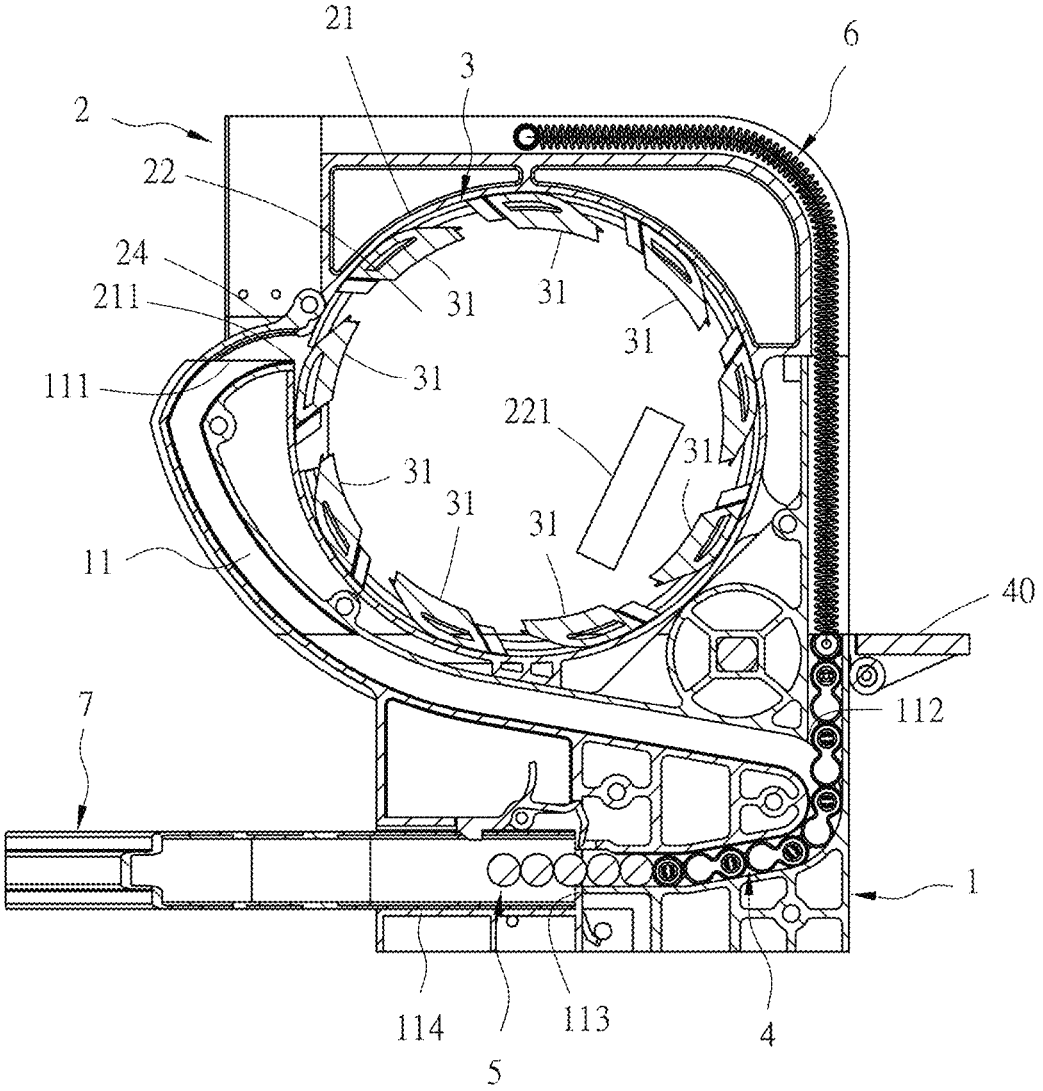
FIG. 12 corresponds to FIG. 11, showing the pressure plate pressed and the flexible connection member pushed the bullets into the magazine.

Referring to FIGS. 1-12, a bullet reload device in accordance with the present invention, comprising a base 1, a roller seat 2, a roller 3, and a flexible connection member 4.

The base 1 comprises an inlet end 111 (refer to FIGS. 9 to 12) above a first side thereof, an outlet end 113 in the first side (refer to FIG. 4), a line-up track 11 extended from the inlet end 111 toward an opposing second side, a turning portion 112 extended from the distal end of the line-up track 11 remote from the inlet end 111 to the outlet end 113 (refer to FIGS. 9 to 12), a magazine slot 114 (refer to FIG. 4) connected to the outlet end 113 in the first side direction, at least one guide rail 116 (refer to FIG. 5) provided on an inner wall of the line-up track 11 so that the extractor groove 51 of the bullet 5 (refer to FIG. 5) entering the line-up track 11 can follow the guide rail 116 to correctly roll to the distal end of the line-up track 11, a bullet squeezing channel 12 (refer to FIG. 4) provided on the second side with a lower end thereof connected to an upper part of the turning portion 112, and a motor 13 set at a selected location.

The roller seat 2 is affixed to the top side of the base 1 by first fastening members 20 (refer to FIG. 2), comprising an inner peripheral wall 21, a roller wall 22 connected to the inner peripheral wall 21 for pivoting the roller 3, at least one bullet inlet 221 formed on the roller wall 22 (see FIG. 6 and FIGS. 11-12), a bullet guide outlet 211 formed on the inner peripheral wall 21 (refer to FIG. 6) and disposed adjacent to the inlet end 111 (see FIGS. 9-12) of the line-up track 11 of the base 1, an outer cover 23 affixed thereto opposite to the roller wall 22 by second fastening members 231 (see FIG. 2) to shield the other side of the roller 3, and a track upper cover 24 pivotally connected to a top side thereof corresponding to the upper part of the inlet end 111 of the line-up track 11 of the base 1.

The roller 3 comprises a plurality of equiangularly arranged blades 31 (refer to FIG. 8), and the width W1 (refer to FIG. 8) of one side of each blade 31 is greater than the width W2 of the other side (refer to FIG. 8), a groove 32 (refer to FIG. 8) formed between each two adjacent blades 31 and configured to have a relatively narrower part 321 (refer to FIG. 8) and a relatively wider part 322 (refer to FIG. 8) so that the bullet 5 can fall into the groove 32 only in one single direction, and a first gear 33 meshed with a second gear 131 on the shaft 130 of the motor 13 so that the roller 3 can be rotated by the motor 13 and the bullets 5 in the grooves 32 between the blades 31 (see FIGS. 9-10) can be rotated with the roller 3.

The flexible connection member 4 is inserted into the bullet squeezing channel 12 of the base 1, having a pressure plate 40 provided at a top side thereof. The pressure plate 40 is connected to a locating portion 25 of the roller seat 2 by at least one tension spring 6 (see FIG. 2).

In this way, the bullet inlet 221 of the roller wall 22 of the roller seat 2 can be used to input bullets 5. When the roller 3 is driven by the motor 13 to rotate, the bullets 5 can be trapped in the grooves 32 between the blades 31 only in the single correct direction and rotated with the roller 3 accordingly. When the bullet 5 in the groove 32 is lifted to the bullet guide outlet 211 of the roller seat 2, the bullet 5 is pushed out by the adjacent blade 31 and enters the inlet end 111 of the line-up track 11 of the base 1 (refer to FIG. 9 to FIG. 10). Through the extractor grooves 51 of the bullets 5 (also refer to FIG. 5) to follow the guide rail 116 of the line-up track 11 (refer to FIG. 5), the bullets 5 scroll correctly in the line-up track 11 to the end of the line-up track 11, so that the bullets 5 can be neatly arranged in the line-up track 11. When reload the bullets, insert the empty magazine 7 into the magazine slot 114 of the base 1 (see FIG. 11). Then you only need to press the pressure plate 40 with the palm of your hand, and the flexible connection member 4 can be forced in the non-linear line-up track 11 to push the bullets 5 into the magazine 7 (refer to FIG. 12). It is convenient to operate and save effort. The force application is convenient and labor-saving. When you release the pressure from the pressure plate 40, the elastic restoring force of the tension springs 6 can be used to make the pressure plate 40 and the flexible connection member 4 return to the original position, waiting for the next operation. Therefore, the invention does not need to pre-set the number of bullets 5 to be filled into the magazine 7, and the operation can be repeated until the magazine 7 is fully filled with bullets 5.

In conclusion, the present invention can be summarized to have the following effects:

1. The line-up track 11 has a guide rail 116 set therein, so that the extractor grooves 51 of bullets 5 can follow the guide rail 116 to scroll from top to bottom in the line-up track 11 of base 1 without turning the direction. There will be no jamming caused by bullets in the wrong direction, so that bullets 5 can be neatly arranged in the line-up track 11.

2. Simply pressing the pressure plate 40 with the palm of your hand can conveniently apply force to move the flexible connection member 4 downward along the non-linear line-up track 11 to push the bullets 5 into the magazine 7.

3. The grooves 32 formed between the blades 31 of the roller 3 only let the bullets 5 in the correct direction fall in, so that the bullets 5 in the correct direction can move in a row.

4. There is no need to preset the number of bullets 5 to be filled into the magazine 7. You can fill in multiple bullets at a time and repeat the operation until the magazine 7 is fully filled with bullets 5.

What is claimed is:

1. A bullet reload device, comprising:

a base comprising an inlet end above a first side thereof, an outlet end in the first side, a line-up track extended from said inlet end toward an opposing second side of said base, a turning portion extended from a distal end of said line-up track remote from said inlet end to said outlet end, a magazine slot connected to said outlet end in the first side direction, a guide rail provided on an inner wall of said line-up track so that the extractor groove of the bullet entering the line-up track follows said guide rail to correctly roll to the distal end of said line-up track, a bullet squeezing channel provided on the second side with a lower end thereof connected to an upper part of said turning portion, and a motor set at a selected location;

a roller seat affixed to a top side of said base by a plurality of first fastening members, said roller seat comprising an inner peripheral wall, a roller wall connected to said inner peripheral wall for pivoting a roller, at least one bullet inlet formed on said roller wall, a bullet guide outlet formed on said inner peripheral wall and disposed adjacent to said inlet end of said line-up track of said base, and an outer cover affixed thereto opposite to said roller wall by a plurality of second fastening members;

a roller pivotally connected to said roller wall of said roller seat, said roller comprising a plurality of equiangularly arranged blades, the width of one side of each said blade being greater than the width of an opposite side of each said blade, a groove formed between each two adjacent said blades and configured to have a relatively narrower part and a relatively wider part so that a bullet can fall into each said groove only in one single direction, and a first gear meshed with a second gear on a shaft of said motor so that said roller is rotatable by said motor and bullets in said grooves between said blades are rotatable with said roller; and a flexible connection member inserted into said bullet squeezing channel of said base, said flexible connection member comprising a pressure plate provided at a top side thereof, said pressure plate being connected to a locating portion of said roller seat by at least one tension spring.

2. The bullet reload device as claimed in claim 1, wherein said roller seat further comprises a track upper cover pivotally connected to a top side thereof corresponding to an upper part of said inlet end of said line-up track of said base.

* * * * *